US011129478B2

(12) United States Patent
Sternlight et al.

(10) Patent No.: US 11,129,478 B2
(45) **Date of Patent: *Sep. 28, 2021**

(54) TRAVEL PILLOW

(71) Applicant: CABEAU, INC., Woodland Hills, CA (US)

(72) Inventors: David Bret Sternlight, Canoga Park, CA (US); Kyna Rose Sternlight, Canoga Park, CA (US)

(73) Assignee: Cabeau, Inc., Woodland Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/465,441

(22) Filed: Mar. 21, 2017

(65) Prior Publication Data

US 2017/0188710 A1 Jul. 6, 2017

Related U.S. Application Data

(63) Continuation of application No. 13/488,443, filed on Jun. 4, 2012, now Pat. No. 9,635,962.

(Continued)

(51) Int. Cl.
*A47C 7/38* (2006.01)
*A47G 9/10* (2006.01)

(Continued)

(52) U.S. Cl.
CPC ..... *A47C 7/383* (2013.01); *A47C 31/00* (2013.01); *A47G 9/02* (2013.01); *A47G 9/10* (2013.01);

(Continued)

(58) Field of Classification Search
CPC ..... A47G 9/10; A47G 2009/1018; A47G 2009/006; A47G 9/1027; A47G 9/1045;

(Continued)

(56) References Cited

U.S. PATENT DOCUMENTS 15,581 A 8/1856 Slaughter
D98,959 S 1/1870 Fast (Continued)

FOREIGN PATENT DOCUMENTS

AU 76466/91 11/1991
AU 76466/91 A † 11/1991

(Continued)

OTHER PUBLICATIONS

Integral, (n.d.) Collins English Dictionary—Complete and Unabridged, 12th Edition 2014. (1991, 1994, 1998, 2000, 2003, 2003, 2006, 2007, 2009, 2011,2014). Retrieved May 11, 2018 from https://www.thefreedictionary.com/integral (Year: 1991).*

(Continued)

*Primary Examiner* — Eric J Kurilla
*Assistant Examiner* — Amanda L Bailey
(74) *Attorney, Agent, or Firm* — DLA Piper LLP (US)

(57) ABSTRACT

The present invention discloses a U-shaped travel pillow having a base cushion and raised cushion fixed to the top side of the base cushion. The inner peripheral walls of the base and raised cushions are mutually flush, while the rear walls are mutually flush and substantially flat for better contact with flat surfaces, such as a headrest, seat, or chair. Furthermore, the rear wall of the raised cushion is thinner than the sides, providing more liberty to adjust head position by easily adapting to the shape of the headrest, seat or chair. A removable cover is adapted to cover the base and raised cushions, while a drawstring with an adjustable cinch mechanism can be used for adjusting the travel pillow around the neck.

2 Claims, 3 Drawing Sheets

Related U.S. Application Data

(60) Provisional application No. 61/623,545, filed on Apr. 12, 2012.

(51) Int. Cl.
*A47C 31/00* (2006.01)
*A47G 9/02* (2006.01)

(52) U.S. Cl.
CPC .... *A47G 9/1081* (2013.01); *A47G 2009/1018* (2013.01)

(58) Field of Classification Search
CPC .. A47G 9/1081; A47G 9/1009; A47G 13/121; A47G 7/072; A47G 7/07; A47C 16/00; A47C 7/383; A47C 7/38; A61G 13/121; A61G 7/072; A61G 7/07
USPC ..... D6/595, 596, 601
See application file for complete search history.

(56) References Cited

U.S. PATENT DOCUMENTS 1,468,072 A 9/1923 Millas
1,787,832 A 5/1929 Mueller
2,582,571 A 1/1952 Thoma
D169,631 S 5/1953 Norman et al.
2,774,601 A 12/1956 White
3,164,151 A 1/1965 Vere
3,164,251 A 1/1965 Esmond
3,327,330 A 6/1967 McCullough
3,604,026 A 9/1971 Scheips
4,031,578 A 6/1977 Sweeney et al.
D256,728 S 9/1980 Allen
4,285,081 A 8/1981 Price ..... 5/637
D263,625 S 3/1982 McKnight
4,345,347 A 8/1982 Kantor ..... 5/644
4,398,621 A 8/1983 Baker
4,565,408 A 1/1986 Palley
4,580,659 A 4/1986 Baker
4,617,691 A 10/1986 Monti
4,679,263 A 7/1987 Honer
4,847,933 A 7/1989 Bedford
4,881,529 A 11/1989 Santos
4,887,326 A 12/1989 O'Brien et al.
5,060,661 A 10/1991 Howard
5,205,611 A 4/1993 Stephens
5,313,678 A 5/1994 Redewill
5,339,472 A 8/1994 Yin
5,345,633 A 9/1994 Harnish
5,378,042 A 1/1995 Daneshvar
5,402,535 A 4/1995 Green
D368,527 S 4/1996 Brooke
5,507,718 A 4/1996 Kabat
5,544,378 A 8/1996 Chow
5,588,445 A 12/1996 Obaidi
5,611,601 A 3/1997 Cowgur
5,738,640 A 4/1998 Carlson-Orsi
5,769,708 A 6/1998 Paschke
5,778,469 A 7/1998 Festa
D396,594 S 8/1998 Lefebvre
D396,980 S 8/1998 Novros
D404,238 S 1/1999 Keilhauer
5,946,735 A 9/1999 Bayes
D414,974 S 10/1999 Marrone
D416,745 S 11/1999 Noyes
5,974,607 A 11/1999 Smith
D419,024 S 1/2000 Lenahan et al.
6,010,192 A 1/2000 King ..... 297/397
D420,845 S 2/2000 Rumage
6,042,185 A 3/2000 Cowgur
6,216,298 B1 4/2001 Oliveira
6,219,865 B1 4/2001 Stokesbary
6,230,348 B1 5/2001 Patrikakis ..... 5/636
6,230,349 B1 5/2001 Silver et al. ..... 5/636
6,231,535 B1 5/2001 Mainiero et al.
6,231,635 B1 5/2001 Suzuki et al.
D443,461 S 6/2001 Hall et al.
D444,981 S 7/2001 Hall et al.
D445,624 S 7/2001 Futagami ..... D6/604
6,266,832 B1 7/2001 Ezell
D446,863 S 8/2001 Carroll
6,289,538 B1 9/2001 Fidge
6,345,401 B1 * 2/2002 Frydman ..... A47G 9/10 5/636
6,408,468 B1 6/2002 Comfort
6,435,617 B1 8/2002 McNair
6,447,468 B1 9/2002 Hankins
D481,247 S 10/2003 Roberts et al.
6,640,367 B2 11/2003 Hsia
6,648,416 B2 11/2003 O'Connor
6,658,681 B2 12/2003 Britto et al.
6,679,557 B2 1/2004 Craft et al.
D486,028 S 2/2004 Cathey
6,820,938 B2 11/2004 Barrett
D503,062 S 3/2005 Nash
6,859,939 B1 3/2005 Osburn, Sr.
6,859,965 B1 3/2005 Gourd
6,926,686 B2 8/2005 Cheatham
6,957,462 B1 10/2005 Wilcox
6,966,088 B1 11/2005 Hu
D522,300 S 6/2006 Roberts
7,055,908 B1 6/2006 Williams
7,070,573 B2 7/2006 Axelsson
7,093,903 B2 8/2006 O'Connor
7,185,378 B2 3/2007 Smith
7,195,660 B2 3/2007 Little et al.
7,225,485 B2 6/2007 Binder ..... 5/642
D550,495 S 9/2007 Boutin
7,267,733 B2 9/2007 Szakalos et al.
D553,414 S 10/2007 Boutin
7,306,573 B2 12/2007 Bonutti
D567,562 S * 4/2008 Nash ..... D6/601
7,406,732 B2 8/2008 Ramaiah
7,437,788 B1 10/2008 Holman ..... 5/636
7,451,508 B2 11/2008 Brown et al.
D582,045 S 12/2008 James
D582,713 S 12/2008 Baldwin ..... D6/601
D597,364 S 8/2009 Lindgren
7,571,503 B2 8/2009 Gabriel
7,627,916 B1 12/2009 Gielow
D607,682 S 1/2010 Presman et al.
D613,402 S 4/2010 Roberts
D610,402 S 7/2010 Sternlight et al.
D619,402 S † 7/2010 Sternlight
7,779,492 B2 8/2010 Mangano
7,788,752 B2 9/2010 Tidwell et al.
7,856,687 B2 12/2010 Chou
7,865,987 B2 1/2011 Deetsch
7,909,406 B2 3/2011 Samuelsen
7,926,839 B1 4/2011 Mothaffar
D637,439 S 5/2011 Mettler
D637,440 S * 5/2011 Mettler ..... D6/601
7,938,491 B2 5/2011 Montuore
7,940,947 B2 5/2011 Kaulfuss et al.
7,958,582 B1 * 6/2011 Scamardo ..... A47C 7/383 5/632
D647,624 S 10/2011 Thorgilsdottir et al.
8,100,846 B1 1/2012 LaMonica
8,144,913 B1 3/2012 Myles ..... 381/374
8,221,593 B2 7/2012 Lang et al.
8,239,987 B2 8/2012 Sharp
8,316,488 B2 11/2012 Rojas
8,321,977 B1 12/2012 Kummerfeld et al.
8,402,568 B2 3/2013 Alstin et al.
8,510,884 B2 8/2013 Lee
8,566,986 B1 10/2013 Chu
8,646,134 B1 2/2014 Alletto, Jr.
8,708,414 B2 4/2014 Hurwitz
8,726,421 B2 5/2014 Alvarez
8,763,180 B1 7/2014 Tsai
8,767,985 B2 7/2014 Riopel
8,777,523 B2 7/2014 Stephens et al.
8,783,776 B1 7/2014 Perkins

(56) References Cited

U.S. PATENT DOCUMENTS

| | | | | |
|---|---|---|---|---|
| 8,887,333 | B2 | 11/2014 | Cohen | |
| 8,898,840 | B1 | 12/2014 | Majette | |
| 8,931,127 | B1 | 1/2015 | Moses | |
| 8,984,688 | B1 | 3/2015 | Ibrahim | |
| 9,101,223 | B2 | 8/2015 | Walker | |
| 9,155,408 | B2 | 10/2015 | Alletto, Jr. | |
| 9,186,003 | B2 | 11/2015 | Hsu | |
| D746,080 | S | 12/2015 | Mittelstadt | D6/601 |
| D754,454 | S | 4/2016 | Schwingendorf | D6/601 |
| 9,386,868 | B2 | 7/2016 | Alletto, Jr. | |
| D762,400 | S | 8/2016 | Wong | D6/601 |
| 9,414,691 | B2 | 8/2016 | Blyberg | |
| D769,029 | S | 10/2016 | Okwumabua | D6/601 |
| 9,572,718 | B2 | 2/2017 | Sternlight | |
| 9,635,962 | B2 | 5/2017 | Sternlight et al. | |
| 9,968,197 | B2 | 5/2018 | Wong | |
| 10,001,346 | B2 | 6/2018 | Augustine et al. | |
| 10,173,629 | B2 | 1/2019 | Barbat et al. | |
| 10,178,915 | B1 | 1/2019 | Sternlight et al. | |
| 10,390,580 | B2 | 8/2019 | Olsson et al. | |
| D899,812 | S | 10/2020 | Sternlight et al. | |
| 2001/0040401 | A1 | 11/2001 | Lin | |
| 2001/0054837 | A1 | 12/2001 | O'Connor | |
| 2002/0050007 | A1 | 5/2002 | Kim | |
| 2002/0185573 | A1 | 12/2002 | Bisch | |
| 2003/0038520 | A1 | 2/2003 | Marbutt | |
| 2003/0137178 | A1 | 7/2003 | Craft et al. | 297/452.41 |
| 2003/0159216 | A1 | 8/2003 | Tomcany et al. | |
| 2004/0064893 | A1 | 4/2004 | Sharp | |
| 2004/0200004 | A1 | 10/2004 | Brown et al. | |
| 2004/0237206 | A1 | 12/2004 | Webster | |
| 2005/0150050 | A1 | 7/2005 | Wolf et al. | 5/636 |
| 2005/0179300 | A1 | 8/2005 | O'Connor et al. | |
| 2005/0223492 | A1 | 10/2005 | Littlehorn et al. | |
| 2005/0241068 | A1 | 11/2005 | Tomcany et al. | |
| 2005/0278853 | A1 | 12/2005 | Littlehorn et al. | |
| 2006/0053556 | A1 | 3/2006 | Piontek | |
| 2006/0061186 | A1 | 3/2006 | Funke et al. | |
| 2006/0250015 | A1 | 11/2006 | Buck | |
| 2006/0267392 | A1 | 11/2006 | Charnitski | |
| 2007/0033737 | A1 | 2/2007 | Melton | 5/640 |
| 2007/0056107 | A1 | 3/2007 | Gabriel | |
| 2007/0067915 | A1 | 3/2007 | Pryor | |
| 2007/0180623 | A1 | 8/2007 | Stein | |
| 2007/0209115 | A1 | 9/2007 | Carroll | |
| 2007/0256692 | A1 | 11/2007 | Pearson | |
| 2007/0271703 | A1 | 11/2007 | Brown et al. | 5/636 |
| 2008/0034503 | A1 | 2/2008 | Hightower | |
| 2008/0034504 | A1 | 2/2008 | Schmidt | |
| 2008/0034505 | A1 | 2/2008 | Thomas | |
| 2008/0104764 | A1 | 5/2008 | Chen | |
| 2008/0216244 | A1 | 9/2008 | Minton | |
| 2008/0229498 | A1 | 9/2008 | Grosso | |
| 2009/0013471 | A1 | 1/2009 | Yang | |
| 2009/0019641 | A1 | 1/2009 | Ali | |
| 2009/0133193 | A1 | 5/2009 | Weise | 5/640 |
| 2009/0206646 | A1 | 8/2009 | Mittelstadt | |
| 2009/0276960 | A1* | 11/2009 | Chou | A47G 9/1009 5/640 |
| 2009/0283557 | A1 | 11/2009 | Maginness | |
| 2009/0309406 | A1 | 12/2009 | Campa | |
| 2009/0313761 | A1 | 12/2009 | North et al. | |
| 2010/0036301 | A1 | 2/2010 | Baldauf et al. | |
| 2010/0133888 | A1 | 6/2010 | Montuore | |
| 2010/0175194 | A1 | 7/2010 | Mastrosimone-Gese | |
| 2010/0319131 | A1 | 12/2010 | North | |
| 2011/0017793 | A1 | 1/2011 | Mellion et al. | |
| 2011/0061167 | A1 | 3/2011 | Farley | |
| 2011/0094033 | A1 | 4/2011 | Lee | |
| 2011/0204696 | A1 | 8/2011 | Koehler | |
| 2011/0235832 | A1 | 9/2011 | Riopel | 381/300 |
| 2011/0271421 | A1 | 11/2011 | Vahey | |
| 2011/0314609 | A1 | 12/2011 | Lee | 5/655.3 |
| 2012/0011655 | A1 | 1/2012 | Rojas | |
| 2012/0047656 | A1 | 3/2012 | Benton et al. | |
| 2012/0124747 | A1 | 5/2012 | Soto | |
| 2012/0144590 | A1 | 6/2012 | Sharp | |
| 2013/0061856 | A1 | 3/2013 | Khademi | |
| 2013/0098364 | A1 | 4/2013 | Davis et al. | |
| 2013/0119716 | A1 | 5/2013 | Stronconi | |
| 2013/0125312 | A1 | 5/2013 | Harooni | 5/639 |
| 2013/0226055 | A1 | 8/2013 | Akpotaire et al. | |
| 2013/0232693 | A1 | 9/2013 | Myers | |
| 2013/0232694 | A1 | 9/2013 | Ross et al. | |
| 2013/0254998 | A1 | 10/2013 | Walker | |
| 2013/0305432 | A1 | 11/2013 | Thomson | |
| 2014/0000036 | A1 | 1/2014 | Cohen | |
| 2014/0021751 | A1 | 1/2014 | Lang et al. | |
| 2014/0101823 | A1 | 4/2014 | Thomson | |
| 2014/0310877 | A1 | 10/2014 | Sternlight et al. | |
| 2014/0317849 | A1 | 10/2014 | LeGrand et al. | |
| 2014/0331397 | A1 | 11/2014 | Kasahara et al. | |
| 2015/0013071 | A1 | 1/2015 | Freund | |
| 2015/0059098 | A1 | 3/2015 | Jung | |
| 2015/0091357 | A1 | 4/2015 | Register | |
| 2015/0107025 | A1 | 4/2015 | Dauphin | |
| 2015/0121627 | A1 | 5/2015 | O'Donnell | |
| 2015/0150391 | A1 | 6/2015 | Hsu | |
| 2015/0157134 | A1 | 6/2015 | Ko | |
| 2015/0230635 | A1 | 8/2015 | Abrams | |
| 2015/0257538 | A1 | 9/2015 | MacDougall | |
| 2015/0257555 | A1 | 9/2015 | Wong | |
| 2015/0313293 | A1 | 11/2015 | Hunt | |
| 2015/0320244 | A1 | 11/2015 | Li | |
| 2015/0320626 | A1 | 11/2015 | Lander | |
| 2016/0045008 | A1 | 2/2016 | Cooper | |
| 2016/0183685 | A1 | 6/2016 | Kang | |
| 2017/0000273 | A1 | 1/2017 | Mitchell | |
| 2017/0065108 | A1 | 3/2017 | Thorn | |
| 2017/0135861 | A1 | 5/2017 | Sternlight | |
| 2017/0232874 | A1 | 8/2017 | Blankenship | |
| 2019/0254435 | A1 | 8/2019 | Neu et al. | |

FOREIGN PATENT DOCUMENTS

| | | | |
|---|---|---|---|
| AU | 7646691 | | 11/1991 |
| AU | 199176466 | | 11/1991 |
| AU | 635838 | B2 | 4/1993 |
| AU | 2003201842 | | 10/2003 |
| AU | 2003201842 | A1 | 10/2003 |
| CA | I147293 | A | 5/1983 |
| CN | 85300949 | | 5/1987 |
| CN | 3006418 | | 9/1990 |
| CN | 3010592 | | 9/1991 |
| CN | 3015753 | | 10/1992 |
| CN | 3052608 | | 12/1996 |
| CN | 2370768 | Y | 3/2000 |
| CN | 2459998 | Y | 11/2001 |
| CN | 013590715 | | 12/2001 |
| CN | 2472598 | Y | 1/2002 |
| CN | 3238498 | | 5/2002 |
| CN | 1359071 | A | 7/2002 |
| CN | 3289601 | | 4/2003 |
| CN | 3435056 | | 3/2005 |
| CN | 3440171 | | 4/2005 |
| CN | 3476279 | | 9/2005 |
| CN | 2836650 | | 11/2005 |
| CN | 3487002 | | 11/2005 |
| CN | 3497652 | | 1/2006 |
| CN | 2006301323942 | | 6/2006 |
| CN | 3563694 | | 9/2006 |
| CN | 2836650 | Y | 11/2006 |
| CN | 3578942 | | 11/2006 |
| CN | 3614520 | | 2/2007 |
| CN | 300685967 | | 9/2007 |
| CN | 300690834 | | 9/2007 |
| CN | 300707538 | | 11/2007 |
| CN | 300711427 | | 11/2007 |
| CN | 300774484 | | 5/2008 |
| CN | 300811885 | | 8/2008 |
| CN | 300882439 | | 2/2009 |
| CN | 300892694 | | 3/2009 |
| CN | 300941334 | | 6/2009 |
| CN | 300959418 | | 7/2009 |

(56) References Cited

FOREIGN PATENT DOCUMENTS

| | | | |
|---|---|---|---|
| CN | 301025929 | | 9/2009 |
| CN | 301109905 | | 1/2010 |
| CN | 301137730 | | 2/2010 |
| CN | 301151430 | | 3/2010 |
| CN | 102166088 | | 8/2011 |
| CN | 102166088 | A | 8/2011 |
| CN | 201958085 | U | 9/2011 |
| CN | 202014937 | | 10/2011 |
| CN | 202014937 | U | 10/2011 |
| CN | 202020155 | U | 11/2011 |
| CN | 202669553 | U | 1/2013 |
| CN | 103126791 | A | 6/2013 |
| CN | 203106519 | U | 8/2013 |
| FR | 1076118 | | 10/1954 |
| FR | 1076118 | A | 10/1954 |
| GB | 2198341 | | 6/1988 |
| GB | 2290705 | | 1/1996 |
| GB | 2055656 | | 8/1996 |
| GB | 2519236 | | 9/2017 |
| GB | 2544676 | | 9/2017 |
| JP | 5501979 | | 4/1993 |
| JP | 8308703 | | 11/1996 |
| JP | 11244113 | | 9/1999 |
| JP | 2000015308 | A | 1/2000 |
| JP | 200015308 | | 10/2001 |
| JP | 2003325297 | | 11/2003 |
| JP | 2004275571 | | 10/2004 |
| JP | 3108760 | U | 2/2005 |
| JP | 3132278 | | 5/2007 |
| JP | 1543718 | | 2/2015 |
| KR | 19990015333 | | 2/2000 |
| KR | 20000029799 | | 5/2001 |
| KR | 20010000482 | | 8/2001 |
| KR | 20010007585 | | 8/2001 |
| KR | 20050019575 | | 3/2005 |
| KR | 20050019575 | A | 3/2005 |
| KR | 200424871 | | 8/2006 |
| KR | 20070002191 | | 1/2007 |
| KR | 20070002191 | A | 1/2007 |
| KR | 20080018019 | | 5/2008 |
| KR | 20080039948 | | 10/2008 |
| KR | 20080049371 | | 11/2008 |
| KR | 200450197 | Y1 | 9/2010 |
| KR | 08249610000 | | 11/2015 |
| RU | 34338 | U1 | 12/2003 |
| TW | M448227 | U | 3/2013 |
| WO | 2011122769 | | 10/2011 |

OTHER PUBLICATIONS

For Collins English Dictionary: portion, (n.d.) Collins English Dictionary—Complete and Unabridged, 12th Edition 2014. (1991, 1994, 1998, 2000, 2003, 2006, 2007, 2009, 2011, 2014). Retrieved May 8, 2020 from https://www.thefreedictionary.com/portion (Year: 1991).*

Examination Report from Great Britain patent appl. No. GB1418089.7, dated May 9, 2017.

Examination Report from Great Britain patent appl. No. GB1702164.3, dated May 9, 2017.

U.S. Appl. No. 29/325,226 dated Aug. 4, 2009, Lindgren.

U.S. Appl. No. 29/196,689 dated Mar. 22, 2009.

U.S. Appl. No. 29/327,069 dated Jan. 12, 2010, C. Pressman.

U.S. Appl. No. 29/131,623 dated Jul. 31, 2001, T. Futagami.

U.S. Appl. No. 29/197,503 dated Feb. 1, 2005, L. M. Harris.

U.S. Appl. No. 29/174,190 dated Oct. 28, 2003, B. Roberts.

U.S. Appl. No. 29/218,867 dated Jun. 6, 2006, B. Roberts.

U.S. Appl. No. 29/098,894 dated Jan. 10, 2000, Lenahan.

U.S. Appl. No. 29/262,985, Sep. 11, 2007, C. Boutin.

U.S. Appl. No. 29/129,963 dated Jun. 12, 2001, D. T. Hall.

U.S. Appl. No. 29/224,808 dated Apr. 29, 2008, J. Nash.

U.S. Appl. No. 29/129,962 dated Jul. 17, 2001, D. T. Hall.

Examination from European Patent Appl. No. 13 745 557.2-1653. dated Mar. 7, 2016.

Third Party Observations filed with the Australian IP against Australian Patent Appl. No. 2015202263 and received Feb. 23, 2016.

Examination Report from corresponding patent appl. No. GB1418089.7, dated Feb. 22, 2017.

Search Report from Russian Federation patent application No. 2013131760, dated Mar. 6, 2017.

Notice of Final Rejection from Korean Patent Appl. No. 10-2013-7034274, dated Apr. 15, 2016.

First Office Action (summary) from Mexican Design Appl. No. MX/f/2015/001297, dated Mar. 14, 2016.

Notice of Allowance and Search Report from Taiwanese Patent Appl. No. 104302012, dated Apr. 20, 2016.

Third party observations on Great Britain Appl. No. GB1418089.7 dated Jun. 23, 2016.

Office Action from Columbian Patent Appl. No. 14-249922-4, dated Jun. 16, 2016.

Office Action from U.S. Appl. No. 14/394,259, dated May 7, 2015.

Response to Office Action from U.S. Appl. No. 14/394,259, dated Nov. 9, 2015.

Patent Examination Report No. 2 from Australian Patent Appl. No. 2013206536, dated Jan. 16, 2015.

Notification of Material Filed under Secion 27 from Australian Patent Appl. No. 2013206536, dated Jun. 24, 2014.

Travel Pillow Store http://www.comfycommuter.com.

Third Party Submittal, Kirby IP Canada, dated Sep. 18, 2015.

Third Party Observation from International Appl. No. PCT/US2013/035646, dated Jun. 16, 2014.

Third Party Observation from Australian Appl. No. AU2014100424, dated Jun. 18, 2014.

Supplementary European Search Report from Appl. No. EP13745557, dated Sep. 15, 2014.

Third Party Observation for Appl. No. EP20130745557, dated Jun. 14, 2014.

Examination from European Patent Appl. No. 13 745 557.2, dated Jun. 12, 2015.

Office Action from U.S. Appl. No. 29/568,003, dated Jan. 26, 2017.

Third Party Observations from corresponding UK Patent appl. No. 1418089.7, dated Oct. 27, 2015.

Office Action from U.S. Appl. No. 15/348,742, dated Jan. 9, 2017.

Intention to Grant from European Patent Appl. No. 13 745 557.2-1653, dated Dec. 22, 2016.

Edge. (n.d. ) American Heritage® Dictionary of the English Language. Fifth Edition (2011) Retrieved Jan. 3, 2017 from http://www.thefreedictionary.com/edge.

3rd party observations filed against European Patent Appl. No. 13745557.2 filed on Oct. 26, 2016.

Examination Report from corresponding Great Briatin patent appl. No. GB1702164.3, dated Mar. 15, 2017.

Office Action from U.S. Appl. No. 13/488,443, dated Apr. 18, 2014.

Office Action from U.S. Appl. No. 13/488,443, dated Jul. 23, 2015.

Office Action from U.S. Appl. No. 13/488,443, dated Oct. 29, 2014.

Response to Office Action from U.S. Appl. No. 13/488,433, dated Apr. 28, 2015.

Response to Office Action from U.S. Appl. No. 13/488,433, dated Sep. 18, 2014.

Response to Office Action from U.S. Appl. No. 13/488,433, dated Dec. 12, 2014.

Response to Office Action from U.S. Appl. No. 14/294,259, dated Nov. 9, 2015.

Response to Office Action from U.S. Appl. No. 13/488,443, dated Apr. 28, 2015.

Response to Office Action from U.S. Appl. No. 13/488,443, dated Sep. 18, 2014.

Response to Office Action from U.S. Appl. No. 13/488,443, dated Dec. 12, 2014.

Notice of Preliminary Rejection from Korean Patent Appl. No. 1-2013-7034274, dated Jul. 2, 2015.

Second Office Action from Chinese Patent Appl. No. 2013800005476, dated May 11, 2015.

(56) References Cited

OTHER PUBLICATIONS

Invitation to Respond to Written Opinion, Written Opinion and Search Report from Singapore Patent Appl. No. 11201406500T, dated Apr. 14, 2015.
Japanese Notice of Reason for Rejection for Application No. 2015-505833; dated Jun. 18, 2017.
Office Action Response for United Kingdom Application No. 1418089.7; dated Jun. 16, 2017.
Office Action Response for United Kingdom Application No. 1702164.3; dated Jun. 15, 2017.
Mexican Office Action for Application No. MX/a/2014/012201; dated Nov. 1, 2017.
Complete Support Travel Pillow by Cabeau, Inc.; Admitted Prior Art under 35 U.S.C. § 102(b), circa 2010.
Complete Support Travel Pillow, shown at http://contest-corner.com/travel-piliow/ (last visited Dec. 5, 2017); dated Nov. 4, 2010.
Office Action from Japanese Patent Appl. No 2015-505833, dated Jun. 13, 2017.
U.S. Appl. No. 15/348,742, filed Nov. 20, 2016, Pending.

* cited by examiner
† cited by third party

TRAVEL PILLOW

CROSS-REFERENCE TO RELATED APPLICATIONS

This application claims the benefit and is a continuation of U.S. patent application Ser. No. 13/488,443, filed on Jun. 4, 2012, and claims the benefit of U.S. Provisional Patent Application 61/623,545, filed on Apr. 12, 2012, each of which is fully incorporated by reference herein in its entirety.

FIELD OF THE INVENTION

This invention relates to pillows, and more particularly to a travel pillow.

DISCUSSION OF RELATED ART

A pillow generally provides support for the head and neck, typically in a laying position. A travel pillow, conversely, is designed to provide support for the head and neck while seated, as is common during long automobile, train, and airplane trips. A travel pillow is generally "U" shaped and is adapted to fit around the neck of a person. A travel pillow can prevent neck strain and promote comfort by supporting a person's neck and head vertically.

U.S. Pat. No. 6,230,349 to Silver et al. on May 15, 2001, describes a travel pillow having a compact size and U-shape for cradling the head and neck of a user while sitting. This device is adapted to allow the user to allow or remove fill material in order to adjust firmness. While this invention is capable of providing neck support, it does not provide adequate neck support in left, right, and forward positions. Furthermore, this travel pillow will force the person's head forward, causing neck strain.

U.S. Pat. No. 4,345,347 to Kantor on Aug. 24, 1982, describes a cushion having a U-shaped portion for supporting the head and neck of a user while sitting. This device is adapted to accept a sleeve to cover parts of the cushion that will touch skin or hair, and includes weights for balancing the device on the shoulders. While this invention is capable of providing neck support, it does not provide adequate neck support in left, right, and forward positions and is not adapted to prevent an extreme forward head position.

U.S. Pat. No. 98,859 to Fast on Jan. 18, 1870, describes a travel pillow having a cushion for promoting the comfort of passengers while traveling. This device comprises an inflatable semi-circular cushion and a strap adapted to form the cushion around the neck by applying downward force with the arms. While this invention is capable of providing neck support, it does not provide adequate neck support in left, right, and forward positions and is not adapted to prevent an extreme forward head position.

While several travel pillows exist in the prior art, few provide adequate support for alternative head positions. Furthermore, travel pillows are notorious for forcing the head forward, causing neck strain. Finally, current travel pillows do not adequately support a front position due to the gap of the "U" shape. Therefore, there is a need for a travel pillow that can provide adequate neck support for all head positions without causing undue strain. Furthermore, a need exists for a travel pillow that will not force the head forward in a rearward position. The present invention accomplishes these objectives.

SUMMARY OF THE INVENTION

The present invention discloses a travel pillow comprising a U-shaped, pliable base cushion with a second U-shaped raised cushion fixed to the top side of the base cushion. The inner peripheral walls of the base and raised cushions are mutually flush, providing a comfortable surface for the neck. Furthermore, the rear walls of the base and raised cushions are mutually flush and substantially flat for better contact with flat surfaces, such as a headrest, seat, or chair. The rear wall of the raised cushion is thinner than each side portion of the raised cushion, providing more liberty to adjust head position by easily adapting to the shape of the headrest, seat or chair. A removable cover is adapted to cover the base and raised cushions. The cover is reversible, where the outside of the cover has a contrasting appearance to the inside of the cover.

The raised cushion is ergonomically designed to comfortably fit around the neck without causing undue strain. Furthermore, the raised cushion is adapted to prevent interfere with a person wearing headphones. Pockets can be positioned on the outside and bottom of the base cushion for storing electronic devices and other objects. A drawstring with an adjustable cinch mechanism can be used for adjusting the travel pillow around the neck.

The U-shape of the travel pillow is generally intended to providing support to the head while traveling. As such, the base cushion and raised cushions are integrally formed from a memory foam material adapted to fit securely, yet comfortably, around the neck, providing adequate ergonomic support to the head when seated in an upright position. The travel pillow can be shaped like an animal, character, or sports team logo.

The present device is a travel pillow that can provide adequate neck support for all head positions without causing undue strain. Furthermore, a need exists for a travel pillow that will not force the head forward in a rearward position. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
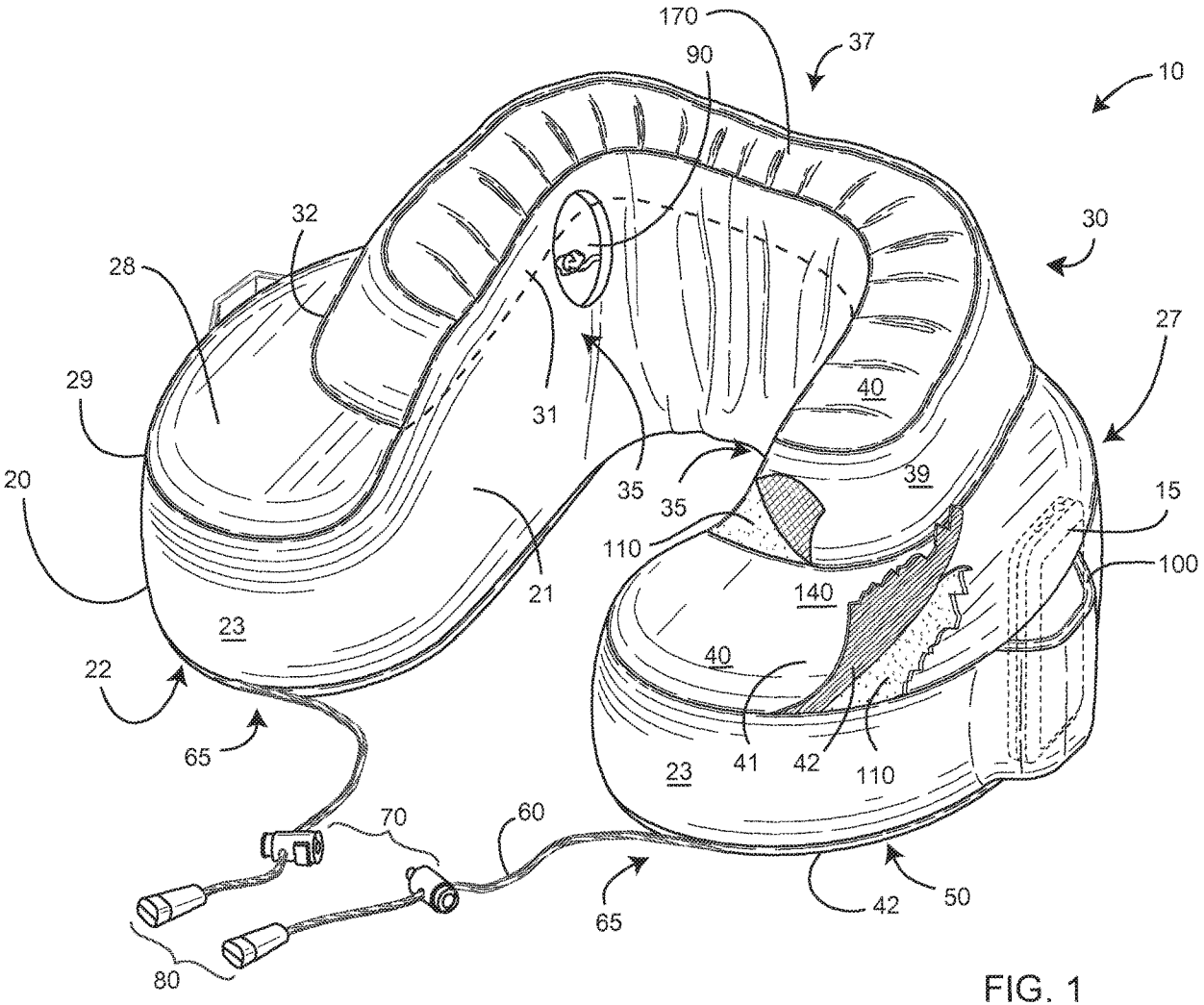
FIG. 1 is a perspective view one embodiment of the invention.
Figure 2:
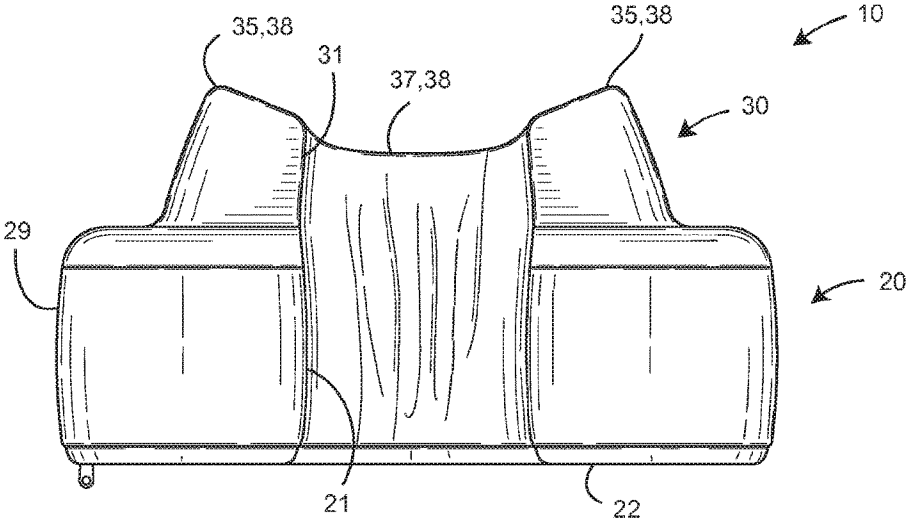
FIG. 2 is a front elevational view thereof, a drawstring illustrated in FIG. 1 omitted for clarity of illustration.
Figure 4:
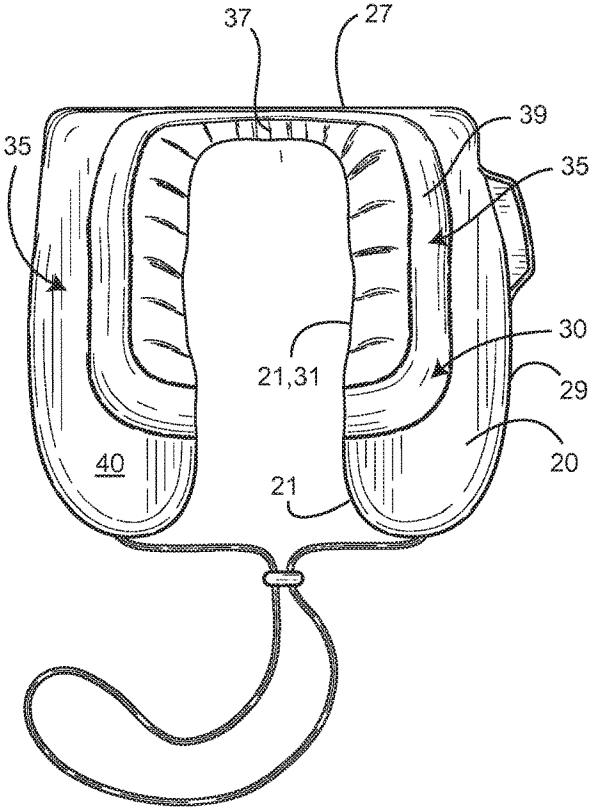
FIG. 4 is a top plan view of the embodiment of FIG. 1.

FIGS. 1 and 2 illustrate a travel pillow 10 comprising a U-shaped, pliable base cushion 20 having a top side 28, bottom side 22, outer peripheral wall 29, inner peripheral wall 21, rear wall 27, and a pair of opposing front walls 23. A U-shaped raised cushion 30 is fixed to the top side 28 of the base cushion 20. The raised cushion 30 comprises a top side 38, bottom side 32, outer peripheral wall 39, and inner peripheral wall 31, all defining a rear portion 37 and two opposing side portions 35 of the raised cushion 30 (FIG. 4). The inner peripheral walls 21, 31 of the base and raised cushions 20, 30 are mutually flush, providing a comfortable surface for the neck.

Figure 3:
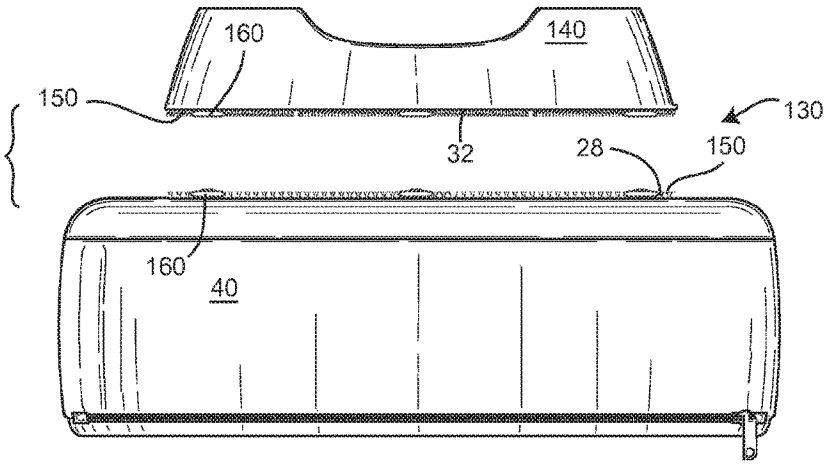
FIG. 3 is a rear elevational view of an alternate embodiment of the invention.

The top side 38 of the base cushion 20 is substantially flat, while the top side 38 of the raised cushion 30 is curved (FIG. 2) or flat (FIG. 3) between the inner and outer peripheral walls 31, 39 thereof. The rear walls 27, 37 of the base and raised cushions 20, 30 are mutually flush (FIG. 4) and substantially flat for better contact with flat surfaces, such as a headrest or chair (not shown). Furthermore, the outer peripheral wall 39 of the raised portion 30 may extend higher than the inner peripheral wall 31 of the opposing side portions 35 (FIG. 2), while the outer and inner peripheral walls 39, 31 of the rear portion 37 are substantially the same height. The rear wall 37 of the raised cushion 30 is thinner than each side portion 35 (FIG. 4), providing more liberty to adjust head position by easily adapting to the shape of the headrest, seat or chair.

Figure 5:
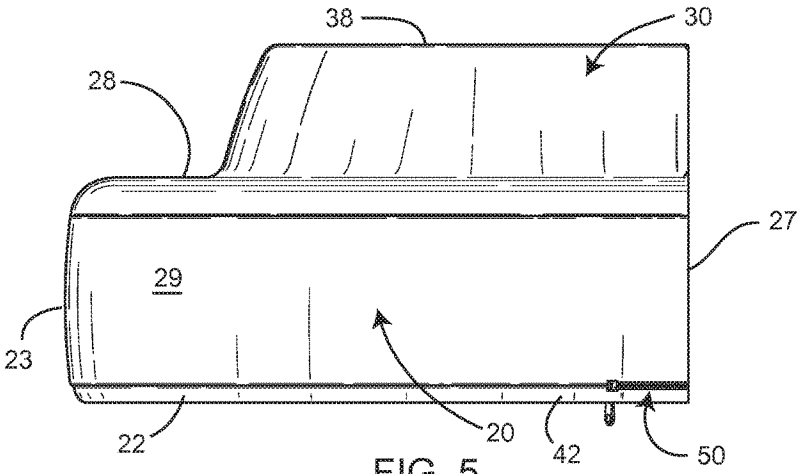
FIG. 5 is a left-side elevational view of the embodiment of FIG. 1, the drawstring omitted for clarity of illustration.

A selectively removable fabric cover 40 is adapted to cover the base and raised cushions 20,30, and includes an opening 50 at a bottom side 42 thereof (FIG. 5). In the preferred embodiment, the fabric cover 40 is reversible, where a first side 41 of the cover 40 has a contrasting appearance to a second side 42 (FIG. 1) of the cover 40. In an alternative embodiment, the base cushion 20 and the raised cushion 30 are selectively mutually detachable (FIG. 3) at a first attachment mechanism 130, such as a zipper (not shown), two-part hook-and-loop type material 150, button, and/or mechanical snap 160. As such, the fabric cover 40 is adapted to cover the base cushion 20, while a second fabric cover 140 (FIG. 3) is adapted to cover the raised cushion 30. The fabric cover 40 may be machine washable, so as to allow for cleaning of the cover 40 from sweat or other grime.

Figure 6:
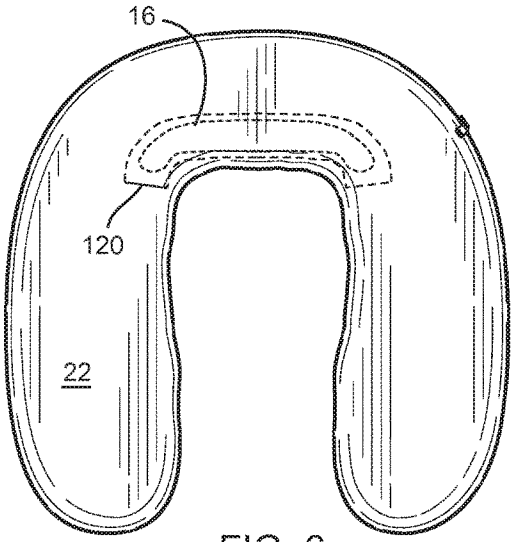
FIG. 6 is a bottom plan view of another embodiment of the invention, the drawstring omitted for clarity of illustration.

The raised cushion 30 includes a pair of opposing recesses 90 (FIG. 1) on the inner peripheral wall 31 of each side portion 35, whereby the raised cushion 30 does not interfere with a person wearing headphones. Furthermore, the outer peripheral wall 29 of the base cushion 20 includes at least one pocket 100 for holding an item 15. In an alternative embodiment, the bottom side 22 (FIG. 6) of the base cushion 20 further includes at least one pocket 120 for receiving a second item 16.

The travel pillow 10 can be used in a first position, where the user can lay his head back on the device 10, or a second position 180-degrees rotated, where the user's chin is supported at a chin support 170 (FIG. 1). Clearly the user can rotate the travel pillow 10 to any suitable and comfortably position as needed, the raised cushion 30 providing varying heights of support to the user's neck and chin, To provide more customization, a drawstring 60 is adapted to adjust the fitting of the travel pillow 10 around the neck. The drawstring 60 has opposing ends 65, each end fixed proximate one of the front walls 23 of the base cushion 20.

The drawstring 60 further comprises an adjustable cinch mechanism 70 for adjusting the tension in the drawstring 60. The cinch mechanism 70 may be adjusted until the front peripheral walls 23 of the base cushion 20 are brought into mutual contact. As such, the travel pillow 10 may be further used as a massage pillow wherein the raised cushion 30 supports the user's face while allowing the user to breathe freely and lay on his stomach. Alternately, the travel pillow 10 in such a configuration may be used as a so-called "massage" or "sun tanning" support for a user's face or the back of the user's head, respectively, while laying either face-down or face-up on a surface.

The U-shape of the travel pillow 10 is generally intended to providing support to the head while traveling. As such, the base cushion 20 and raised cushion 30, in one embodiment, are integrally formed from a foam material 110 adapted to fit securely, yet comfortably, around the neck, providing adequate ergonomic support to the head when seated in an upright position. In the preferred embodiment, the foam material 110 is a memory foam material, with the device 10 having overall dimensions of 10"×10"×5", although any suitable material and size may be used. Other materials include fabrics, air, beads, polyester, grains, aromatherapy material, gels, and other fluids.

While a particular form of the invention has been illustrated and described, it will be apparent that various modifications can be made without departing from the spirit and scope of the invention. For example, an electrical heating and massaging device may be incorporated to provide heat and massage to the neck. Additionally, the travel pillow 10 may be shaped like an animal, cartoon character, sports team logo, or other novelty shape. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A U-shaped travel pillow comprising a substantially U-shaped cushion, the cushion comprising:

a first side portion comprising a first inner surface and a first outer surface, said first side portion defining a first base side portion and a first raised side portion;

a second side portion comprising a second inner surface and a second outer surface, said second side portion defining a second base side portion and a second raised side portion, said second inner surface facing said first inner surface; and a rear portion between said first and second side portions, said rear portion defining a base rear portion and a raised rear portion, said rear portion comprising a third inner surface and a rear surface;

wherein the first side portion, the second side portion, and the rear portion comprises memory foam material;

wherein said rear surface is substantially flat and substantially vertical;

wherein said first inner surface and said first outer surface are at approximately equal heights at corresponding points along said first side portion, and said second inner surface and said second outer surface are at approximately equal heights at corresponding points along said second side portion;

wherein said first base side portion, said second base side portion, and said base rear portion define a base cushion, and said first raised side portion, said second raised side portion, and said raised rear portion define a raised cushion, said raised cushion integral with said base cushion, wherein the maximum width of said base cushion is greater than the maximum width of said raised cushion; and wherein each of said first raised side portion, said second raised side portion, and said raised rear portion has a curved top surface.

2. The U-shaped travel pillow of claim 1, wherein said first raised side portion is on less than all of said first base side portion and wherein said second raised side portion is on less than all of said second base side portion.

* * * * *